US011142900B2

(12) United States Patent
Ishaq

(10) Patent No.: US 11,142,900 B2
(45) Date of Patent: Oct. 12, 2021

(54) SHEAR WALL PANEL

(71) Applicant: Bailey Metal Products Limited, Concord (CA)

(72) Inventor: Nicola Ishaq, Concord (CA)

(73) Assignee: Bailey Metal Products Limited, Concord (CA)

( * ) Notice: Subject to any disclaimer, the term of this patent is extended or adjusted under 35 U.S.C. 154(b) by 0 days.

(21) Appl. No.: 16/852,756

(22) Filed: Apr. 20, 2020

(65) Prior Publication Data

US 2020/0332511 A1 Oct. 22, 2020

(30) Foreign Application Priority Data

Apr. 18, 2019 (CA) ..... CA 3040657

(51) Int. Cl.
*E04B 1/24* (2006.01)
*E04B 1/08* (2006.01)
*E04B 2/58* (2006.01)

(52) U.S. Cl.
CPC ..... *E04B 1/24* (2013.01); *E04B 1/08* (2013.01); *E04B 2/58* (2013.01); *E04B 2001/2481* (2013.01); *E04B 2001/2496* (2013.01)

(58) Field of Classification Search
None
See application file for complete search history.

(56) References Cited

U.S. PATENT DOCUMENTS 6,892,504 B1 * 5/2005 diGirolamo ..... E04B 1/08 52/167.3
6,920,724 B1 * 7/2005 Hundley ..... E04B 1/24 52/167.3
7,140,155 B1 * 11/2006 Nasimov ..... E04B 1/24 52/236.8
7,299,596 B2 * 11/2007 Hildreth ..... E04B 1/24 52/695
7,788,878 B1 * 9/2010 diGirolamo ..... E04B 2/58 52/745.19
8,769,887 B2 * 7/2014 Proffitt, Jr. ..... E04B 2/58 52/167.3
8,925,278 B2 * 1/2015 Sugihara ..... E04B 1/08 52/657
10,280,642 B2 * 5/2019 Zhao ..... E04B 1/2403
2005/0005561 A1 * 1/2005 Hanson ..... E04B 1/24 52/633
2007/0289230 A1 * 12/2007 Schroeder, Sr. ..... E04H 9/14 52/149

FOREIGN PATENT DOCUMENTS

CA 2564549 A1 11/2005

* cited by examiner

*Primary Examiner* — Joshua K Ihezie
(74) *Attorney, Agent, or Firm* — Blake, Cassels & Graydon LLP; Laurie Wright; Christopher N. Hunter

(57) ABSTRACT

A shear wall panel utilizes improved corner connection to effectively connect vertical chords and horizontal tracks of the shear wall panel to diagonal brace members and accommodating anchoring of the panel frame to horizontal building components. The panel frame uses structural corner brackets interiorly mounted to the corners of the panel adapted to receive anchor bolt connection adjacent the corner and diagonal bracing connection at a position spaced from the anchor bolt connection. Preferably, the shear wall panel is manufactured in a factory and shipped to a job site as a finished panel frame.

10 Claims, 6 Drawing Sheets

SHEAR WALL PANEL

FIELD OF THE INVENTION

The present invention relates to shear wall panels and, in particular, to cold-formed steel framing panels.

BACKGROUND OF THE INVENTION

Cold-formed steel (CFS) framing has been widely used for many years in commercial construction in non-load bearing partition wall applications. More recently, CFS framing has been used in structural applications, particularly for mid-rise and multi-housing building projects. Various members of the framing system are made from structural quality sheet steel formed into the appropriate sections, such as C-sections and other shapes, by roll forming the steel through a series of dies. The thickness of the steel and the shape and number of framing members cooperate to meet a particular building structural requirement.

The use of cold-formed steel (CFS) for structural buildings now commonly includes single family homes, mid-rise multistory buildings and high-rise multistory building applications. The buildings are structurally designed to resist different loads including lateral loads such as anticipated wind loads and/or seismic loads. Structural engineers use different lateral force resisting systems (LFRS) to meet these design requirements.

A number of shear wall panels have been used for structural load bearing applications and examples of these panels are shown in Canadian patent application no. 2,564,549 and U.S. Pat. No. 7,299,596. Each of these references disclose a particular reinforcing bracket used at the corners of the structural shear panel frames reinforcing the rectangular panel and accommodating diagonal bracing members extending from diagonally opposite corners of the panel. The bracing members used in these systems are provided interior to the panel such that the outer face of the panels remains consistent with the other components of the building system. A number of earlier systems or onsite fabrications use bracing secured to the exterior surfaces of the panel and create surface finish problems due to a stepped profile when the sheeting is applied to the panel.

Although structural shear wall panels are known, the assembly and quality control of these panels can be difficult, onsite securement of the panels to other structural components can be awkward, and the panels may need to be adapted for different field installation issues.

There remains a need for an improved structural shear wall panel and, in particular, to a bracing arrangement provided, preferably at the corners of the frames of the panels that reinforces the panels and could reduce possible installation issues.

SUMMARY OF THE INVENTION

A shear panel, according to the present invention, comprises a top track and an opposed lower track joined by opposed chord studs on opposite sides of the panel. These components define a generally rectangular panel. The shear wall panel includes a plurality of interior studs extending perpendicular between and secured to the top and lower tracks. The panel at the interior junctions between the opposed chord studs and the upper and lower tracks, each include an L-shaped structural bracket. Each L-shaped structural bracket includes a horizontal flange and a perpendicular vertical flange. The horizontal flange adjacent a free end thereof, includes a brace flange extending into the interior space of the panel and spaced from the vertical flange. The horizontal flange further includes an anchor port passing through the horizontal flange and separated from the brace flange defining securement access adjacent the anchor port. The structural shear panel includes diagonal brace members extending diagonally between opposite corners of the panel with the brace members connected to the brace flanges of the L-shaped structural brackets.

In an aspect of the invention, each L-shaped structural bracket is welded to the respective track and the respective chord stud.

In a further aspect of the invention, each anchor port is an elongate slot port with a length thereof that extends in a length of the horizontal flange.

In a further aspect of the invention, each brace flange is orientated to be perpendicular to the horizontal flange and perpendicular to the vertical flange. Each brace flange has a brace securing port passing through the brace flange and an end of one of the brace members is secured to the brace flange using the brace securing port.

In a further aspect of the invention, each diagonal brace includes a pivot pin connection securing the diagonal brace member to the respective brace flanges.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
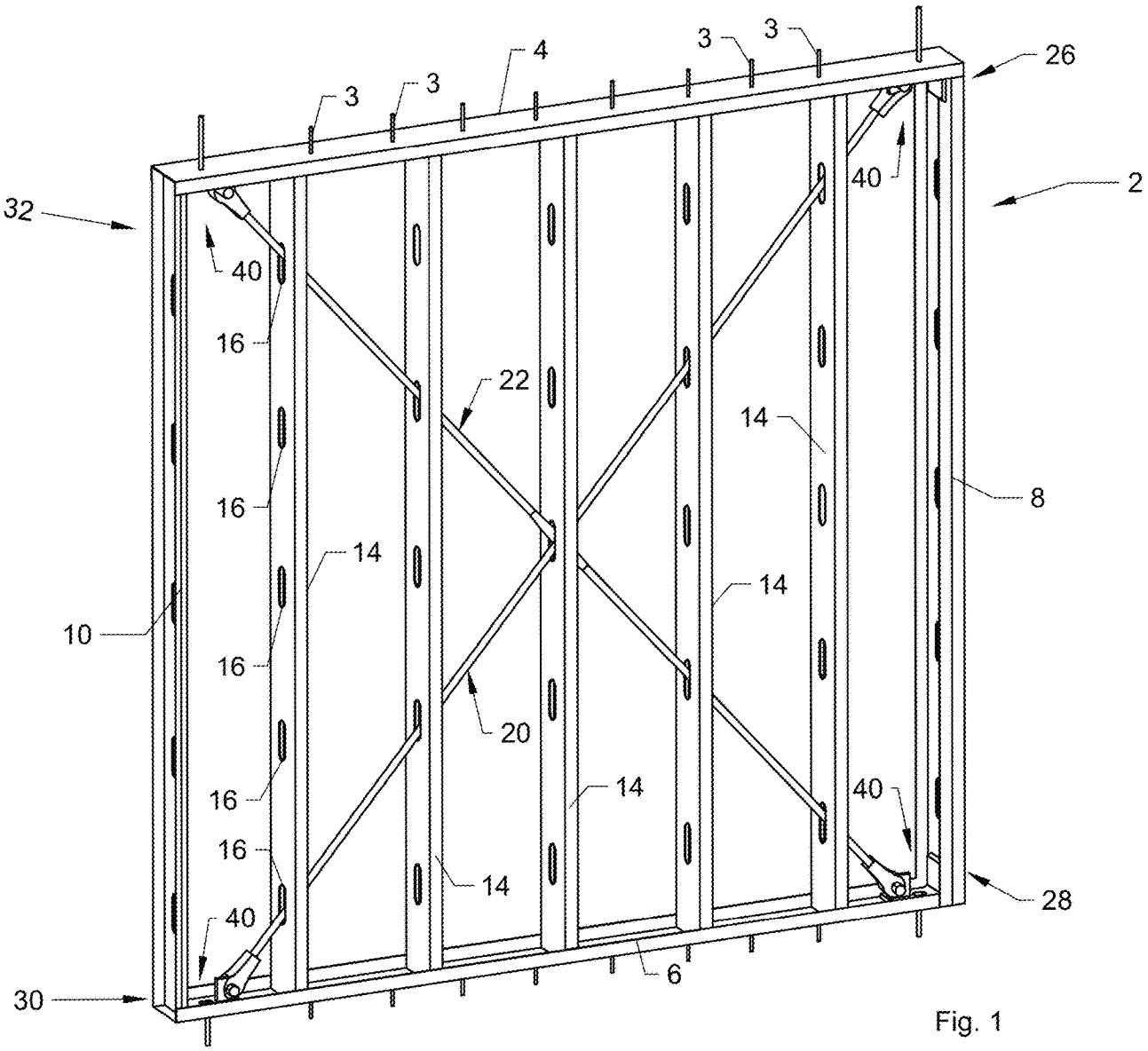
FIG. 1 is a perspective view of the shear wall panel.
Figure 2:
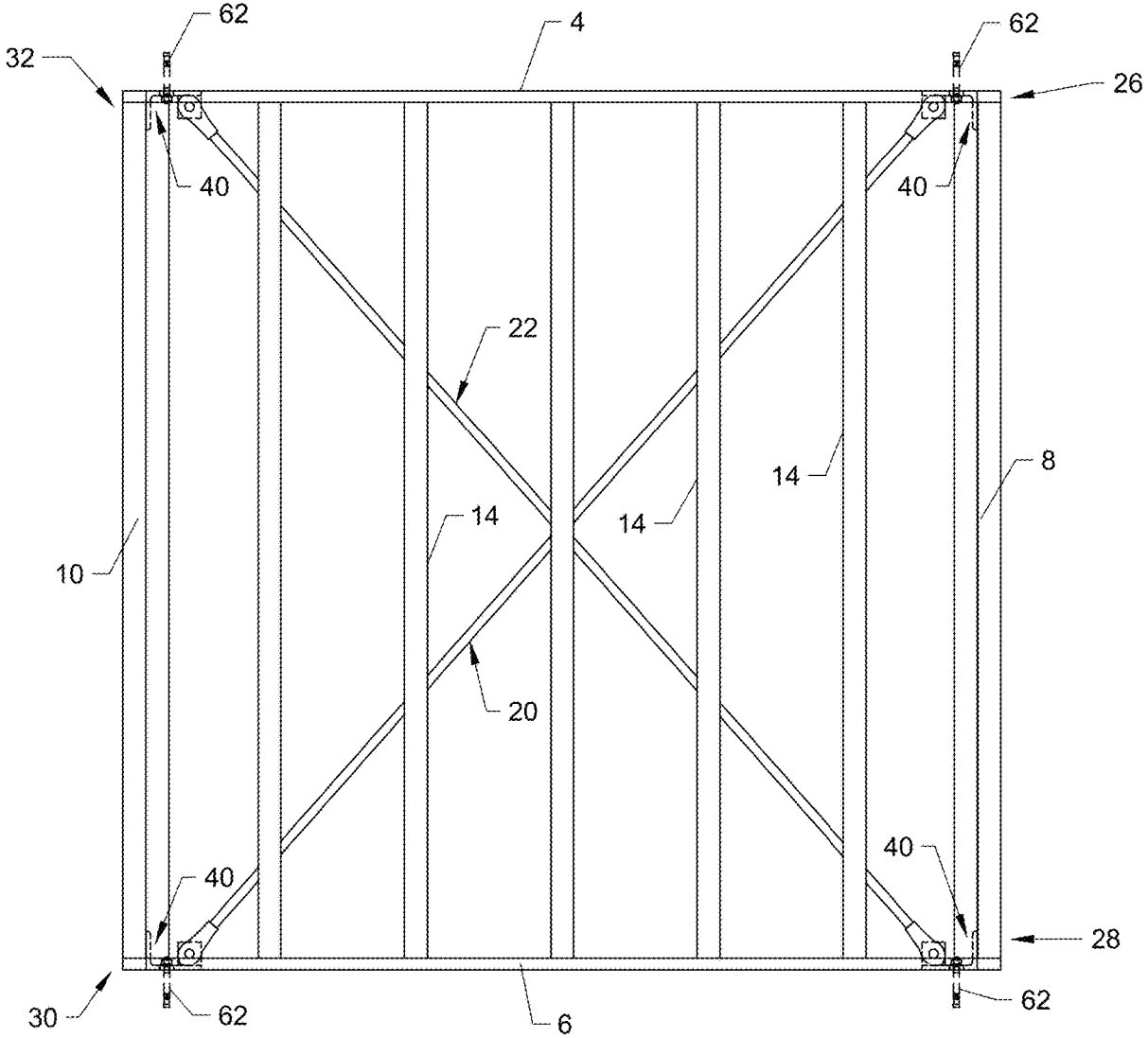
FIG. 2 is an elevation of the shear wall panel.

FIGS. 1 and 2 show a structural shear wall panel 2. While this example embodiment is shown as rectangular in shape, it can be appreciated that the apparatus could be adapted. The structural shear wall panel includes a top track 4, typically a U-shape channel that opens downwardly towards the opposed upwardly opening U-shaped lower track 6. The upper and lower tracks are connected by the chord studs 8 and 10, either side of the shear wall panels. These chord studs are designed to take high vertical loads and the chord studs are designed to be anchored to the top and the bottom building structure via the L-shaped structural steel brackets 40 and appropriate mechanical securement. Diagonal bracing members 20 and 22 extend between diagonally opposite corners of the shear wall panel to oppose lateral shear forces. The corners of the shear wall panel are indicated as 26, 28, 30 and 32. In a preferred embodiment, the shear wall panel 2 is manufactured offsite and taken to the jobsite as a finished product. However, it can be appreciated that the panel could also be assembled onsite.

As shown in FIG. 2, the shear wall panel cooperates with building anchor members 62 which pass through the steel L-shaped structural brackets 40 used as part of the mechanical securement of the panel to the building structure. The anchor members typically include a base portion embedded in the horizontal concrete slab or floor structure.

Each shear wall panel 2 also includes a series of intermediate studs 14 at particular spacings along the upper and lower tracks. The intermediate studs are perpendicular to the upper and lower track and are secured to the upper and lower tracks in a conventional manner. Each of the intermediate studs includes slot openings 16 appropriately positioned to allow the diagonal brace members 20 and 22 to pass through the studs. Preferably, each of the intermediate studs 14 include a series of slot openings, shown as 16 in FIG. 1, whereby each intermediate stud can be used at any of the appropriate positions in the length of the upper or lower track members and allow the brace members to pass therethrough.

It is well known to use structural shear wall panels and/or strong framing components at different positions in a wall to satisfy lateral force resisting system design requirements. The shear wall of the present disclosure includes improvements with respect to the connection of the chord studs 8 and 10 to the corner brackets and the effective connection of the diagonal brace members 20 and 22 between the diagonally opposed corners of the shear wall panel.

The brace members are typically rod or cable members and adjustable in length such that the brace member can be tensioned in the field after installation and initial loading. The preferable ability to adjust the length and tension of the brace members in the field can provide some added functionality and adaptablity. Although the shear wall panel is manufactured in a factory setting, installation site conditions can negatively impact the design strength of the panel and, in particular, can affect the tension of the diagonal bracing. For example, if there are variations in the level of the floors, some distortion of the panel may occur. Onsite adjustment of diagonal bracing members, during installation, after the panel is installed and/or after the panel is loaded, improves the structural integrity and performance of the installed shear wall panel. In the preferred embodiment, the adjustment of the diagonal bracing members is done after the panel is installed and loaded to be adjusted for the final loaded conditions of the panel. The ability to adjust the tension in the diagonal braces in the field, allows the installed shear wall panel to perform in the anticipated manner while being tolerant of possible site variations.

As will be subsequently described, it is preferable to have the diagonal brace members directly connected to the L-shaped structural braces by a pivot type connection with the adjustment in the length of the diagonal bracing member occurring at a position within the panel and, preferably, spaced from the L-shaped structural brackets.

A first embodiment of the L-shaped structural brackets 40 is shown in FIGS. 3 through 6. In this embodiment, the L-shaped structural brackets 40 can be made of any suitable material known to a person skilled in the art but is preferably made of structural steel. When in use, the L-shaped brackets 40 are preferably welded to the chord studs and the respective tracks. The L-shaped bracket 40 has at least two structural flanges, including the horizontal flange 42 and the vertical flange 44. The horizontal flange 42 is coupled or connected to the upper track 4 or lower track 6 while the vertical flange is coupled, connected or positioned directly adjacent to a chord stud 8 or 10. This provides additional structure and a perpendicular corner of the shear wall panel. L-shaped structural brackets 40 are designed to provide a rigid fastening of the corner components.

The shear wall panel 2 is anchored to the opposed horizontal structural components of the building. Typically, the shear wall panel is anchored to the concrete floors of the building above and below the shear wall 2 using anchor bolt arrangements.

Figure 3:
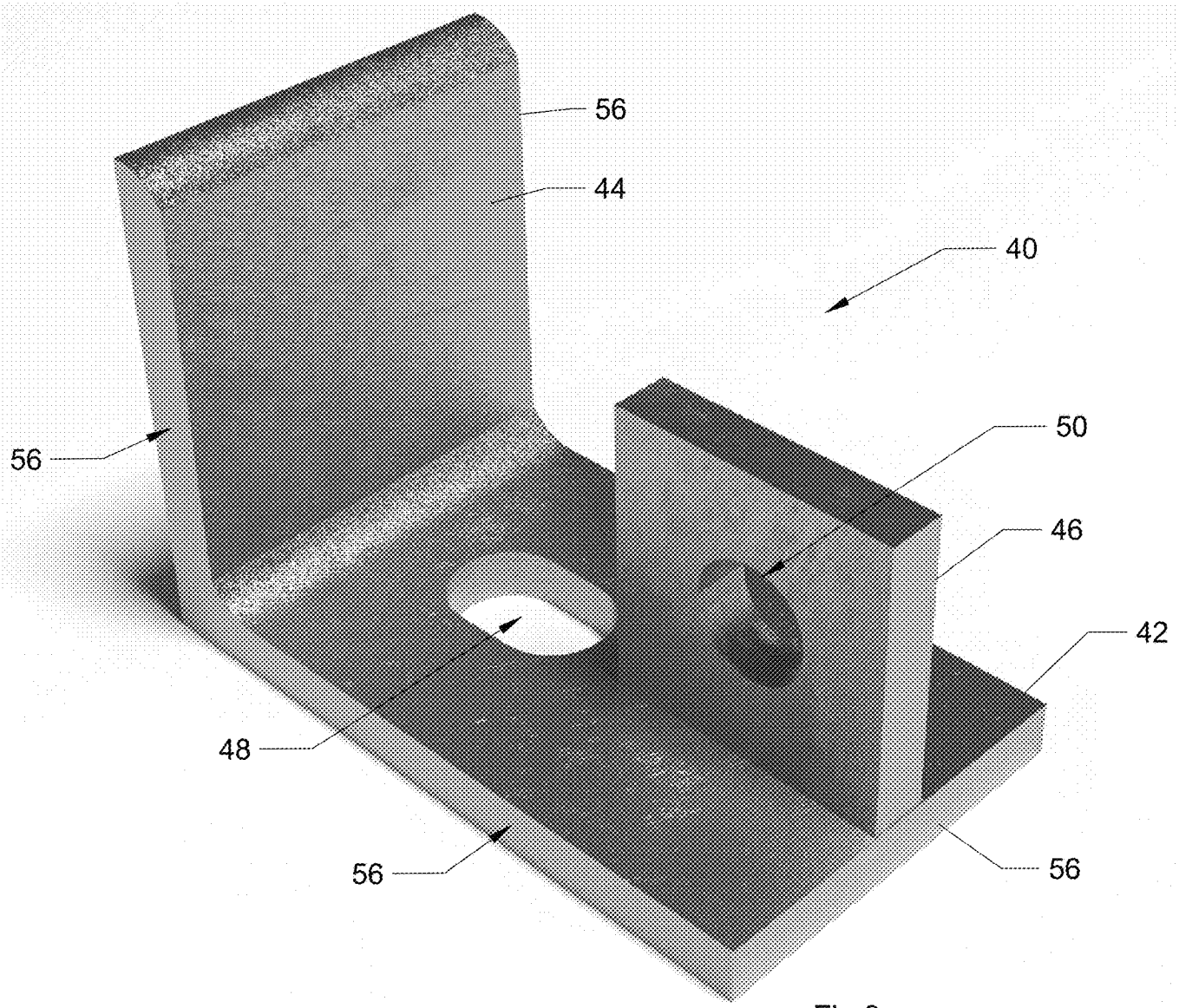
FIG. 3 is a perspective view of the L-shaped structural bracket.
Figure 4:
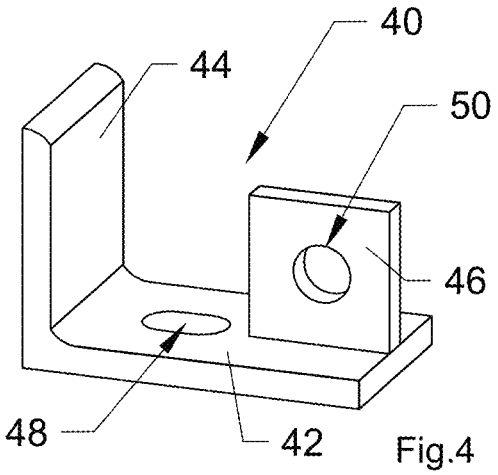
FIG. 4 is a further perspective view of the L-shaped structural bracket.
Figure 5:
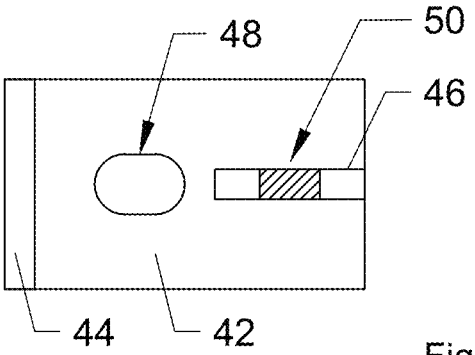
FIG. 5 is a top view of the L-shaped structural securing bracket.
Figure 6:
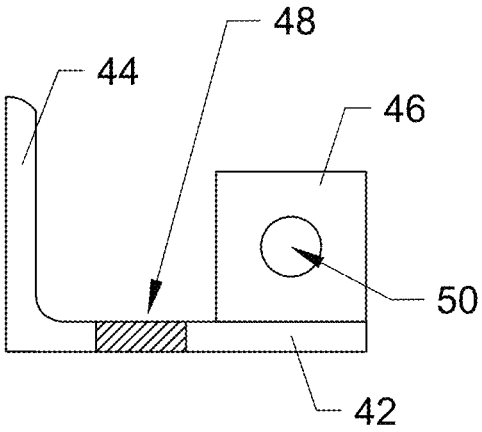
FIG. 6 is a side view of the L-shaped structural securing bracket.

With the L-shaped structural bracket 40, as shown in FIG. 3, the horizontal flange 42 includes the anchor port 48 that is closely spaced but separated from the vertical flange 44. While the anchor port 48 could be a variety of different shapes, in a preferred embodiment this anchor port 48 is a slot type opening. The slot type opening gives some room to allow for adjustment in the vertical alignment of shear panels between floors. An anchor bolt 62 passes through the anchor port 48 to accommodate positive securement of the shear wall panel 2 to the building structure horizontal members. An aligned port is also provided in the respective top or bottom track member.

As shown in the Figures, the brace flange 46 is located on the horizontal flange 42 at the free end thereof and spaced from the anchor port 48. The brace flange 46 includes a brace port 50 that engages an end of the diagonal braces. Preferably, this engagement is a pivot pin type connection with adjustment in the length of the diagonal braces 20 and 22 occurring at a position spaced from the L-shaped structural bracket.

The periphery 56 of the L-shaped structural brackets 40 is preferably connected via a weld to the chord studs or track.

The L-shaped structural bracket 40 shown in FIGS. 3 to 6, is designed to allow the horizontal flange 42 to support the brace flange 46 at a position offset relative to the corners of the shear wall panel 2 with these corners shown as 26, 28, 30 and 32 in FIG. 2. With this arrangement, the lower horizontal structural member of the building is secured to the adjacent upper horizontal member via the shear wall panel and is reinforced by the L-shaped brackets in combination with the diagonal bracing members such that the wall panel is stiff and opposes any horizontal shifting of these horizontal components. Each of the chord studs is anchored to and bottom to the building horizontal structural members and the diagonal bracing is also anchored via the brackets.

The L-shaped brackets provide sufficient space about the anchor ports to allow for mechanical connection with the anchor members and provide a strong mechanical connection of the anchor members to the shear wall panel frames. Furthermore, the connection of the diagonal bracing members to the L-shaped brackets is convenient and is spaced outwardly from any congestion adjacent the connection of the anchor type members through the anchor port of the L-shaped bracket.

The diagonal bracing members have been described as being separate members that define an X-type configuration between the upper and lower tracks, however, these members can be manufactured as integrated X-frame bracing members that include a particular joining at the intersection point of the X. It is preferred that the adjustment in the length of the bracing members occurs at a position spaced from the mechanical connection of the bracing members to the L-shaped structural brackets, however, it is possible that the ends of the diagonal bracing members can include a thread type adjustment that is provided adjacent the L-shaped structural members but spaced to one side thereof. If necessary, the pivot type connection can be temporarily released to improve access at the anchor bolt connection.

As can be appreciated, depending upon the particular building and the anticipated environment of the building, the design requirements can vary significantly. In the present system, the L-shaped structural brackets are designed for maximum load applications such that the same L-shaped structural bracket can be used in shear panels of different widths and/or different capacities. These L-shaped structural brackets can be received in a six-inch-wide vertical chord and tracks, however, the same brackets can also be used for higher load applications, for example, a ten inch wide panel frame. For assembly, it is desirable that the bracket extends across essentially the width of the frame, but it is not necessary. Welding of the L-shaped structural brackets to the chords and, preferably, the tracks regardless of the widths thereof strongly secures the components at the corners of the panel frames and simplifies anchoring of chord studs and the diagonal bracing to the building structure.

With the present arrangement, the shear wall panel frames can be manufactured in a factory type setting according to the particular requirements of a building or to meet particular design requirements. The shear wall panel frames can be installed onsite and the diagonal bracing members can be adjusted, if necessary, to provide the appropriate tensioning after the panel frame is installed and when the panel frame is under vertical load. The factory manufacture of the shear wall panel frames provides high quality control that is difficult to consistently maintain with onsite panel assembly or partial assembly. The particular shape and spacing of the functional components of the L-shaped brackets allows effective installation of the shear wall panel to the other building components in a manner to realize the initial design performance of the wall panels.

FIG. 7 through 10 show an alternate bracket 140 that is designed for mechanical securement to the vertical chords of a shear panel frame. There are a number of applications where factory and/or field assembly of panels is preferred without welding of the bracket to the panel frame. The alternate bracket 140 is designed for this application.

The alternate bracket 140 includes a series of screw ports 142 in the back panel 144 for receiving screw fasteners to mechanically secured bracket 140 to a vertical chord stud. The bracket 140 includes a structural steel horizontal flange 152 having an anchor port 154 and a brace flange 156 with a securing port 158.

The back panel 144 and the side gussets 160 are preferably formed from a single piece of a cold formed steel. The back panel 144 and the side gussets 160 are preferably welded to the horizontal flange 152. The anchor port 154 is located between the brace flange 156 and the back panel 144 as discussed with respect to L-shaped bracket 40. The finished bracket 140 is provided in its assembled configuration (shown in FIGS. 7 through 10) to allow assembly of panels without requiring welding.

Figure 7:
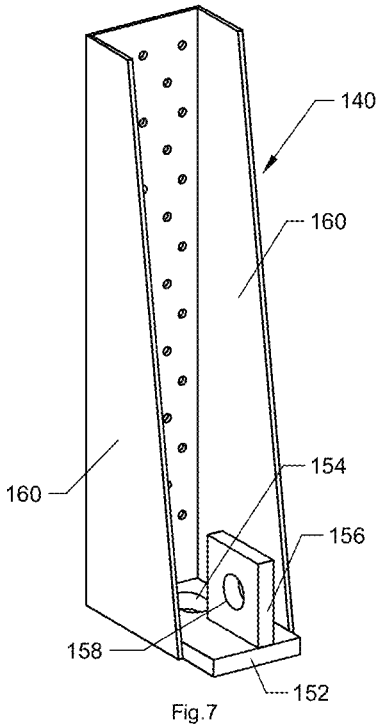
FIG. 7 is a perspective view of an alternate bracket designed for mechanical securement to vertical chord studs of a shear wall panel.
Figure 8:
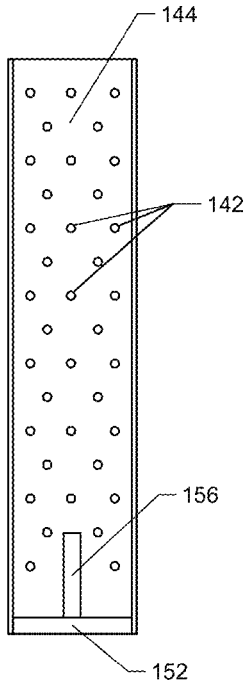
FIG. 8 is a front view of the alternate bracket.
Figure 9:
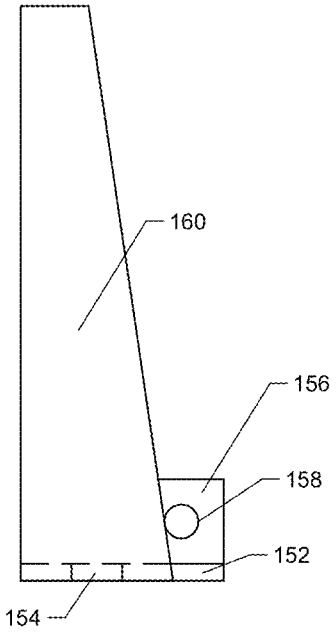
FIG. 9 is a side view of the alternate bracket.
Figure 10:
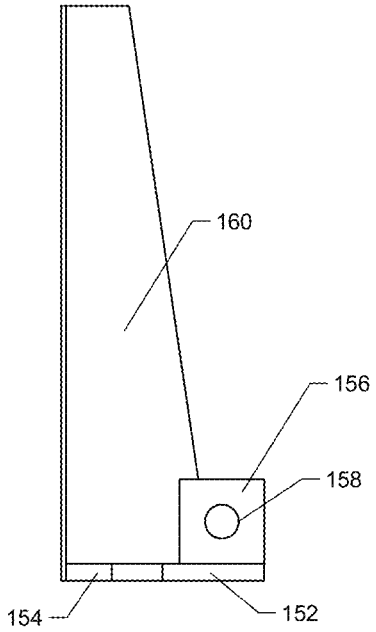
FIG. 10 is a side view of the alternate bracket with a side gusset removed to clearly show the brace flange.

The back panel 140 and side gussets 160 are of increased height relative to vertical flange 44 of L-shaped bracket 40, shown in FIGS. 1 through 6. This provides additional area for mechanical connection to chord studs and additional distribution of forces. As shown in FIG. 7, the back panel 140 and side gussets 160 are of cold formed steel welded to the structural steel of the horizontal flange 152.

Figure 11:
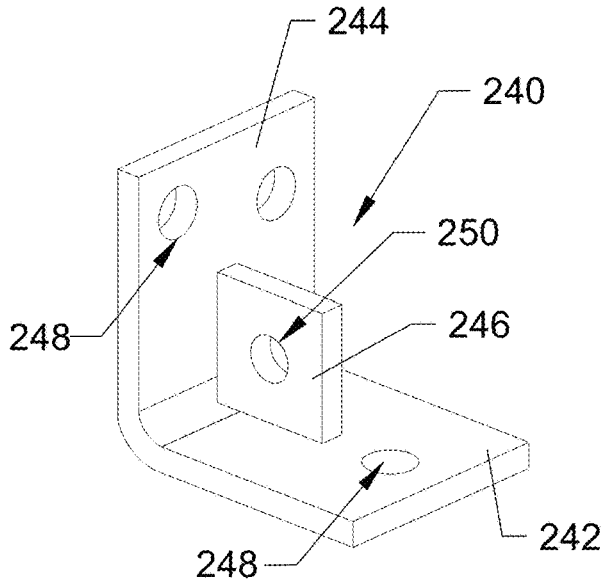
FIG. 11 is a perspective view of yet another alternate bracket for use in a shear panel.
Figure 12:
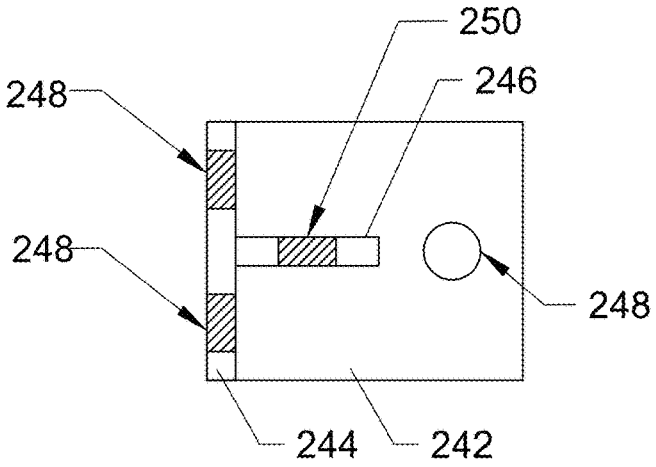
FIG. 12 is a top view of the alternate bracket shown in FIG. 11.
Figure 13:
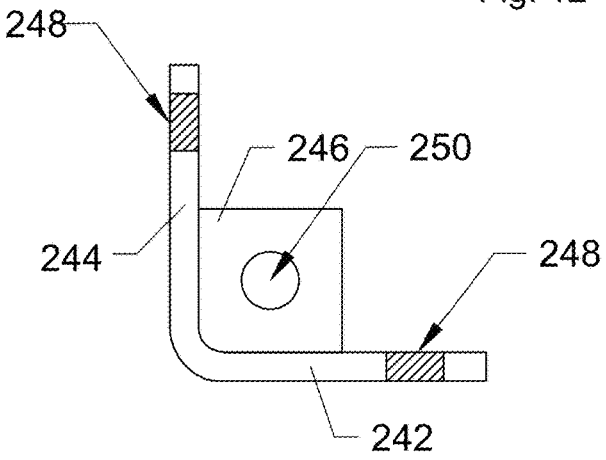
FIG. 13 is a side view of the alternate bracket shown in FIG. 11.

FIGS. 11 to 13 show a third embodiment of a bracket 240 for welding or mechanical securement to the vertical cords or track of the shear panel frame. This embodiment includes a first flange 242 and a second flange 244 positioned approximately perpendicular to each other. A brace flange 246 is provided at the corner between the first flange 242 and second flange 244. The brace flange 246 preferably has a first edge and a second edge coupled to, connected to or integral with the top surface of the first flange 242 and front surface of the second flange 244 respectively. The brace flange 246 includes a brace port 250 that engages an end of the diagonal braces. Preferably, this engagement is a pivot pin type connection with adjustment in the length of the diagonal braces 20 and 22 occurring at a position spaced from the bracket.

The periphery 256 of the brackets 240 is preferably connected via a weld to the chord studs or track.

The first flange 242 includes the anchor port 248*a* that is spaced distally from the second flange 244 and brace flange 246. An anchor bolt 62 passes through the anchor port 248*a* to accommodate positive securement of the shear wall panel 2 to the building structure horizontal members. An aligned port is also provided in the respective top or bottom track member.

The second flange 244 also includes two anchor ports 248*b* and 248*c*. By including anchor ports 248*b* and 248*c* on the second flange 244, the bracket 240 can be used in a first orientation wherein the first flange is coupled to the chord stud or a second orientation wherein the second flange 244 is coupled to the chord stud. The anchor ports 248*b* and 248*c* are positioned outwardly from the corner of the bracket and outward of the brace flange 246. In a preferred embodiment, anchor ports 248*b* and 248*c* are offset of center and are spaced outwardly at different distances from the corner of the bracket 240.

The bracket 240 shown in FIGS. 11 to 13, is designed to allow both of the first flange 242 and second flange to support the brace flange 246 at a position close to the corners of the shear wall panel 2 with these corners shown as 26, 28, 30 and 32 in FIG. 2. With this arrangement, the lower horizontal structural member of the building is secured to the adjacent upper horizontal member via the shear wall panel reinforced by the brackets and the diagonal bracing members such that the wall panel is stiff and opposes any horizontal shifting of these horizontal components. Each of the chord studs is anchored top and bottom to the building horizontal structural members and the diagonal bracing is also anchored via the brackets.

Bracket 40, bracket 140 and bracket 240 each provide effective reinforcement and transfer of lateral loads at the corners of a shear wall panel frame by effective anchoring of the chord studs and diagonal bracing to the building structure. Additionally, the brackets 40, 140 and 240 maintain good access for field installation of the shear wall panel to anchor bolts of the building structure.

Although various preferred embodiments of the present invention have been described herein in detail, it will be appreciated by those skilled in the art that variations may be made thereto without departing from the scope of the appended claims.

The invention claimed is:

1. A shear wall panel comprising a top track and an opposed lower track joined by opposed chord studs forming opposite sides of said panel and defining a generally rectangular panel;

a plurality of interior studs extending perpendicularly between and secured to said top and lower tracks; and wherein said panel at interior corners defined at junctions between said opposed chord studs and said top and lower tracks includes L-shaped structural brackets;

each L-shaped structural bracket including a horizontal flange and a perpendicular vertical flange;

said horizontal flange adjacent a free end thereof including a brace flange extending into the interior of the panel and spaced from said vertical flange;

said brace flange having a brace securing port extending therethrough in a direction perpendicular to a horizontal longitudinal axis of said panel;

said horizontal flange further including an anchor port passing through said horizontal flange and separated from said brace flange sufficiently to provide effective securement access adjacent said anchor port; and wherein said structural shear panel includes diagonal adjustable length braces extending between opposite diagonal corners of said panel and connected to said brace flanges.

2. A shear wall panel as claimed in claim 1 wherein each L shaped structural bracket is welded to the respective track and respective chord stud.

3. A shear wall panel as claimed in claim 2 wherein each anchor port is an elongate slot port with a length thereof extending in a length of said horizontal flange.

4. A structural shear panel as claimed in claim 3 wherein each brace flange is orientated to be perpendicular to said horizontal flange and perpendicular to said vertical flange; and wherein an end of one of said braces is secured to said brace flange using said brace securing port.

5. A structural shear panel as claimed in claim 4 wherein each diagonal brace includes pivoting pin connections to the respective brace flanges.

6. A structural shear panel as claimed in claim 1 wherein said vertical flange of each L-shaped bracket has a back panel secured to said horizontal flange at an end thereof and two opposed side gussets connected to said back panel and forming a U-shape with said back panel with said side gussets connected to opposed sides of said horizontal flange at said end thereof.

7. A shear wall panel as claimed in claim 6 wherein said back panel and said side gussets are formed from a single sheet of cold formed steel.

8. A shear wall panel as claimed in claim 6 wherein said horizontal flange is made of a hot rolled structural steel plate.

9. A shear wall panel as claimed in claim 6 wherein said back panel and side gussets include a weld securement to said horizontal flange.

10. A shear wall panel as claimed in claim 6 wherein said side gussets are wider at said horizontal flange and taper upwardly to be of a narrower width at the junction with said back panel.

* * * * *